United States Patent [19]

Frushtick

[11] Patent Number: 4,479,315

[45] Date of Patent: Oct. 30, 1984

[54] STEAMING APPARATUS FOR A VERTICAL SIDE CHEST IN A TROUSER PRESSER

[75] Inventor: Leonard Frushtick, Denver, N.C.

[73] Assignee: Leonard Automatics, Inc., Denver, N.C.

[21] Appl. No.: 532,792

[22] Filed: Sep. 16, 1983

[51] Int. Cl.[3] ..... D06F 71/28

[52] U.S. Cl. ..... 38/42; 38/14

[58] Field of Search ..... 38/14, 27, 42, 43, 26, 38/93, 85, 5, 77.7, 77.8, 77.81, 77.82, 77.83, 77.9, 16

[56] References Cited

U.S. PATENT DOCUMENTS

| | | | |
|---|---|---|---|
| 951,673 | 3/1910 | Ball | 38/16 X |
| 2,469,742 | 5/1949 | Newhouse | 223/73 |
| 2,846,793 | 8/1958 | Studer | 38/93 X |
| 3,319,847 | 5/1967 | Hoisve et al. | 223/73 |
| 3,413,741 | 12/1968 | Schwartz, Jr. et al. | 38/93 X |
| 3,415,430 | 12/1968 | McMillan | 223/73 |
| 3,715,819 | 2/1973 | Hanson | 38/16 |
| 4,342,409 | 8/1982 | Brollos | 223/73 |
| 4,352,252 | 10/1982 | Brenot | 38/16 |

*Primary Examiner*—Werner H. Schroeder
*Assistant Examiner*—Andrew M. Falik
*Attorney, Agent, or Firm*—W. Thad Adams, III

[57] ABSTRACT

Vertical side chests (23) for a presser (10) which include both heating means (81) and steaming means (88) positioned within each side chest (23). Vertically aligned, elongate slots (77) are formed in the pressing surface (75) of the side chests (23) thereby ensuring a uniform application of steam along the length and width of the trousers. Steam is applied to the trousers at substantially right angles thereto.

12 Claims, 26 Drawing Figures

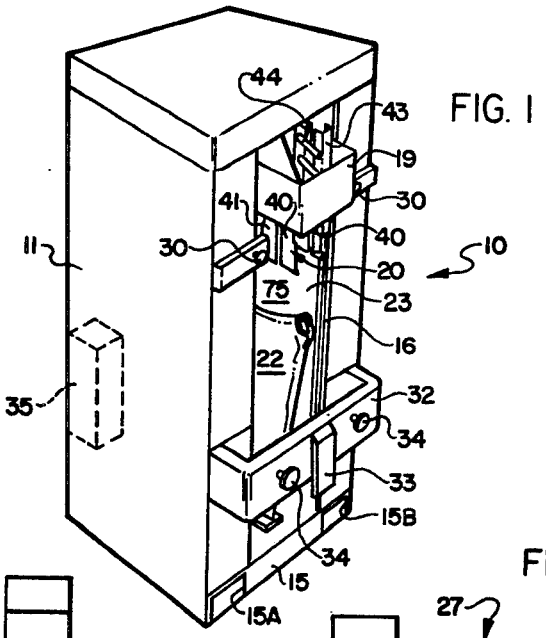
FIG. 1
FIG. 2
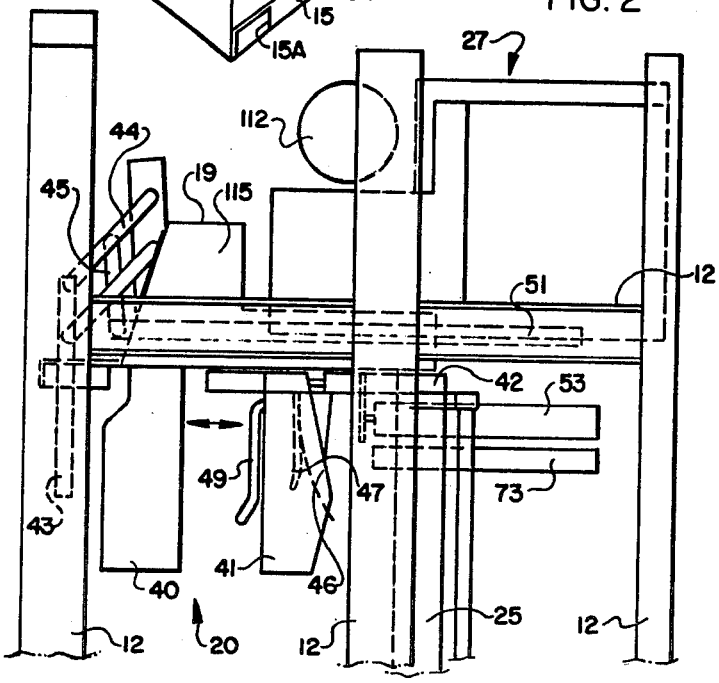

FIG. 15
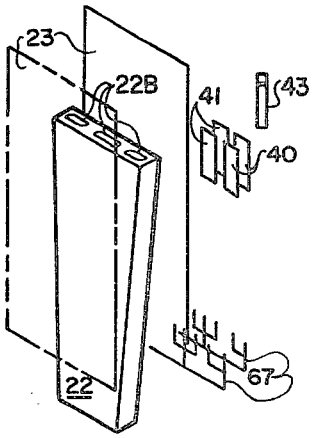
FIG. 16
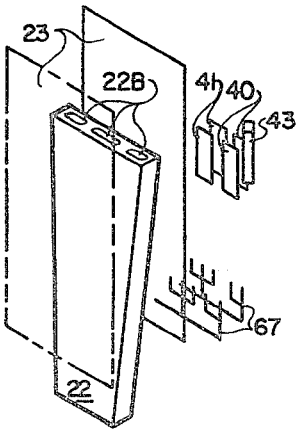
FIG. 17
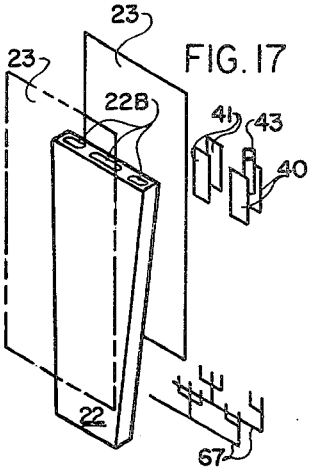
FIG. 18
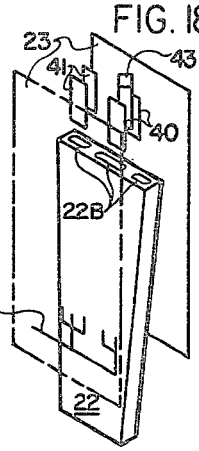
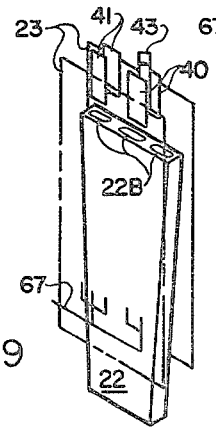
FIG. 19

STEAMING APPARATUS FOR A VERTICAL SIDE CHEST IN A TROUSER PRESSER

TECHNICAL FIELD AND BACKGROUND OF THE INVENTION

This invention relates to a trouser finisher having vertical side chests with uniform steaming and drying means for pressing a pair of trousers, and a method of pressing trousers. The particular disclosure in this application relates to a trouser finisher of the type used in the final stages of garment manufacture. However, the apparatus and method disclosed in this application have application in other areas as well, such as in dry cleaning and laundering facilities. This application relates to U.S. patent application Ser. Nos. 532,793; 532,788; 532,791; 532,968; and 532,789.

The machine described in this application generally includes a frame, a stationary center buck mounted on the frame, a waist expander mounted on the frame for receiving the torso portion of a pair of trousers and leg expanders mounted on the frame for receiving the cuffs of a pair of trousers and holding the legs of the trousers in a tensioned condition on either side of the center buck. A side chest is mounted on either side of the center buck and is moveable between a retracted position away from the center buck and a pressing position against the center buck during a pressing cycle.

The trousers are pressed by first applying steam to the trousers and then pressing the trousers with a heated surface to dry trousers in their pressed position. In known prior art machines, the steam is applied to the trousers from a steam tube which typically resides on the forward leading edge of each side chest. Consequently, steam is applied at a very acute angle to the trousers. Since the steam is typically applied through a relatively small number of nozzles, the steam radiates outwardly, becoming more diffused the further the distance travelled from the nozzle. Since the rear of the trousers may be ten inches (25 cm.) or more from the nozzle, much less steam will be applied to the rear of the trousers than to the front. More specifically, if the optimum amount of steam is applied to a particular point on the trousers relatively close to the steam nozzles, then another point on the trousers twice as far away from the steam nozzle will receive only about one fourth the amount of steam. Another area on the trousers four times as far away from the steam nozzle as the optimum area will receive only one sixteenth the amount of steam. If the nozzles are adjusted to apply the optimum amount of steam to the central portion of the trouser, then areas of the trouser closer to the nozzle receive too much steam while areas further away from the nozzle still receive too little steam.

Since the trousers may be dry at the end of the pressing cycle, the heated surfaces must be timed to completely dry the portion of the trousers which receive the most steam. Therefore, areas of the trousers receiving less steam are overdryed and in extreme cases may be scorched or marked by receiving a substantially excess amount of heat.

It has also been observed that prior art steaming nozzles generally have a circular orifice. This causes the steam to expand in a cone-shaped manner although the shape of the trousers to which the steam is being applied is basically trapezoidal with only a slight taper from top to bottom. Finally, it has been observed that round steam nozzles tend to encourage faster condensation of the steam into water bubbles which results in a "wetter" steam which saturates into the fibers on the surface of the trouser fabric before penetrating into the interior structure of the fabric.

SUMMARY OF THE INVENTION

Therefore, it is an object of the invention to provide a vertical side pressing chest which applies a uniform quantity of steam across the entire surface area of a pair of trousers.

It is another object of the present invention to provide a vertical side pressing chest which incorporates steam apertures so that steam may be uniformly applied to a pair of trousers and then pressed by the same side chests and uniformly dried.

It is another object of the present invention to provide a side chest for a trouser presser which has a plurality of uniformly spaced-apart steam apertures therein, each of the steam apertures comprising elongate slots to prevent formation of water bubbles and premature condensation of steam as steam is applied to the trousers through the apertures.

It is yet another object of the present invention to provide a method of uniformly steaming and drying a pair of trousers to obtain a high quality press finish on a pair of trousers.

These and other objects and advantages of the present invention are achieved in the preferred embodiment of the vertical side pressing chests and method summarized below.

The trouser presser includes a frame, a stationary center buck mounted on the frame, a waist expander mounted on the frame for receiving the torso portion of a pair of trousers and leg expanders mounted on the frame for receiving the cuffs of a pair of trousers and holding the legs of the trousers in a tensioned condition on either side of the center buck. A side chest is mounted on either side of the center buck and is moveable between a retracted position away from the center buck and a pressing position against the center buck during a pressing cycle. Each of the side chests preferably comprises pressing means defining a pressing surface for pressing a pair of trousers against a center buck. The pressing surface is provided with a plurality of uniformly spaced-apart apertures along its length and width.

Heating means are provided for heating the pressing surface so as to permit heat transfer from the pressing surface to the trousers. Steam supply means are provided for supplying steam to the apertures on the pressing surface for a spray application of a uniform quantity of steam to the trousers at substantially right angles thereto. The spray application of steam is made while the pressing surface is spaced apart from the center buck before commencement of the pressing cycle.

Preferably, the apertures comprise elongate slots to prevent formation of water bubbles and premature condensation of steam as steam as applied to the trousers through the apertures.

According to the embodiment of the invention shown in this application, the means for heating the pressing surface of the side chests comprises a pressure vessel for receiving pressurized, high-temperature steam from the steam supply means. The pressure vessel is positioned in heat transfer relation to the pressing surface but is sealed against steam transfer therebetween.

In this particular embodiment of the invention, the pressure vessel comprises a serpentine heater channel extending along the width and length of the side chest for evenly distributing heat to the side chest. The steam supply means also includes a serpentine steam supply channel in fluid communication with the apertures on the pressing surface of the side chest for distributing an even supply of steam to the apertures for application to the trousers.

According to the method disclosed in this application, a pair of trousers is mounted on a center buck for pressing. A side chest is provided with a plurality of uniformly spaced-apart apertures through which steam is applied in a uniform quantity to the trousers at substantially right angles thereto resulting in a uniform application of steam. Then the heated side chests are moved against the steamed. surface of the trousers and the trousers are uniformly dried.

BRIEF DESCRIPTION OF THE DRAWINGS

Some of the objects of the invention have been set forth above. Other objects and advantages of the invention will appear as the description of the invention proceeds, when taken in conjunction with the following drawings, in which:

FIG. 1 is a general, perspective view of a trouser presser according to the present invention;

FIG. 2 is a partial, vertical, schematic cross-sectional view of the upper, waist expander assembly portion of the trouser pressure;

FIGS. 15 through 19 are schematic views of the trouser presser according to the present invention in various stages of operation;

DESCRIPTION OF THE PREFERRED EMBODIMENT

Figure 3:
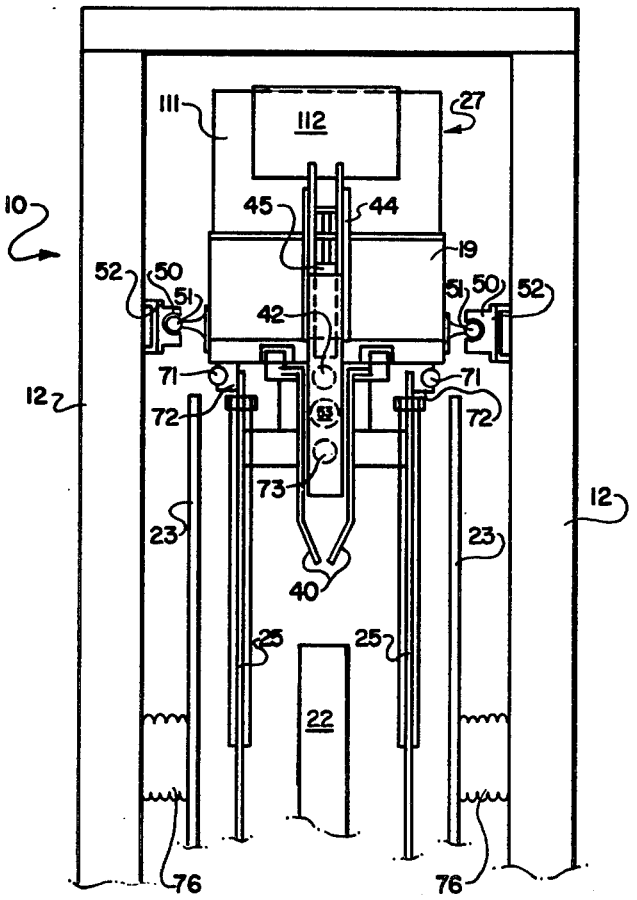
FIG. 3 is a schematic, front view of the trouser presser shown in FIG. 1, with parts removed for clarity.

Referring now specifically to the drawings, a trouser presser generally according to the present invention is shown in FIG. 1 and is designated at broad reference numeral 10. Presser 10 includes a cabinet 11 and frame 12 within which the working components of presser 10 are positioned. The presser 10 is formed of several upright and horizontal frame members. Frame 12 is secured to a base 15 (FIG. 1) which includes spaced apart voids **15*a* and 15*b* which are adapted to receive the fork of a forklift truck to assist moving presser 10** from one location to another.

Before describing the components of presser 10 in detail, the major components will be generally identified with continued reference to FIG. 1 as well as other figures. Cabinet 11 defines a longitudinally extending front operator access opening 16 which extends substantially from the top to the bottom of presser 10. Mounted in the upper end of presser 10 for reciprocating movement into and out of the cabinet 11 through the front access opening 16 is a head assembly 19 within which is mounted a waist expander assembly 20. A center buck 22 is stationarily secured to base 15 and extends upwardly towards the waist expander assembly 20. Heated side pressing chests 23 (FIGS. 1 and 3) are positioned on both sides of center buck 22 for reciprocating movement into and out of pressing contact with center buck 22. A pair of leg expanders 25 collectively define a leg expander assembly 26. Leg expanders 25 are positioned on either side of center buck 22 and are mounted for reciprocating movement between a position on either side of center buck 22 and a position forward of center buck 22 through access opening 16. A trouser inflator assembly 27 is stationarily mounted within cabinet 11 behind head assembly 19 on a frame member of frame 12. (See FIG. 2).

The operator controls of presser 10 are located on the front of cabinet 11 near access opening 16. These controls include two hand buttons 30, referred to below as "step forward" buttons; one on either side of access opening 16. The remaining controls are positioned on an outwardly extending guard 32 which is positioned at operator knee level. Positioned in the center of guard 32 is a knee button 33. Positioned on either side of knee button 33 are two "step back" buttons 34. The function of each of these controls will be explained in further detail below.

All of the above-described controls as well as the pneumatic cylinder assemblies are controlled from a control panel 35 which includes a microprocessor and related logic circuitry which responds to commands received which responds to commands received from the operator controls and activates the various machine functions.

Referring now to FIG. 2, waist expander 20 is shown in more detail. Waist expander assembly 20 comprises a pair of front waist bucks 40 having front and opposing side surfaces for receiving and engaging the front torso part of a pair of trousers. Waist expander assembly 20 also includes a pair of rear waist bucks 41 having rear and opposing side surfaces for receiving and engaging the rear torso part of a pair of trousers, with the trousers encircling both the front waist bucks 40 and rear waist bucks 41. Front and rear waist bucks 40 and 41, respectively, are mounted in a conventional manner on a linkage for alternate movement to and from each other to define a closed, or collapsed, position where the trousers are held loosely, and an open, or expanded, position where the trousers are held in a tensioned condition for being pressed. The front waist bucks 40 and rear waist bucks 41 are moved to and from each other in the manner described by means of an air cylinder 42.

The trousers are held against the front surface of the front waist buck 40 by a heated fly buck 43 which is suspended above and to the front of the front waist buck 40 by means of a parallelogram linkage 44 which is operated by an air cylinder 45. Fly buck 43 reciprocates between an open position, shown in FIG. 2, and a closed position shown in FIG. 10. In its closed position, fly buck 43 engages the fly portion of the torso of the trousers and securely positions the fly in a centered position between the pair of front waist bucks 40 while pressing the fly with heat. The rear torso part of the trouser is positioned against the rear surface of rear waist buck 41 by means of a rear take-up 46 and a cooperating spring 47. When the trousers are placed around rear waist buck 41, the rear portion of the trousers is slipped in between spring 47 and rear take-up 46 holding them in position. With the trousers in position, air cylinder 42 is activated moving front and rear waist bucks 40 and 41 apart and tensioning the trousers therearound.

Figure 4:
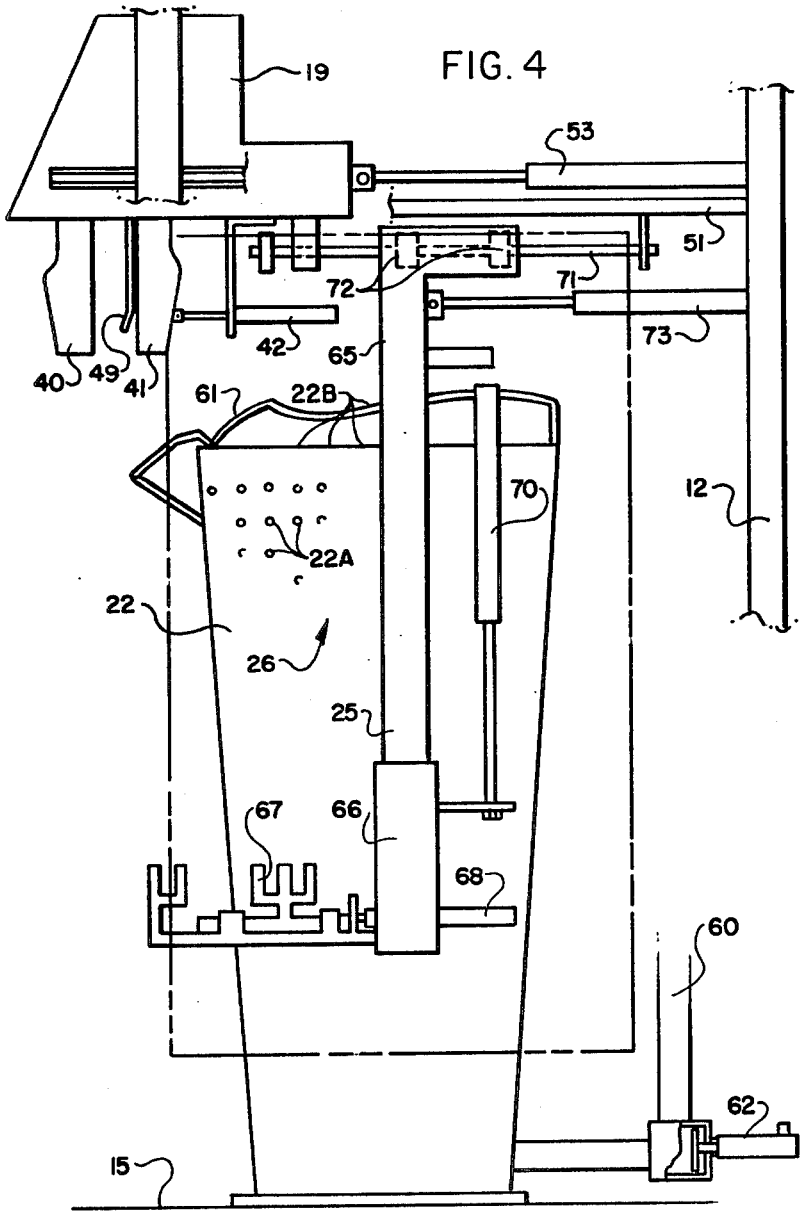
FIG. 4 is a partial, side view of the trouser presser shown in FIG. 1, with parts removed for clarity.
Figure 8:
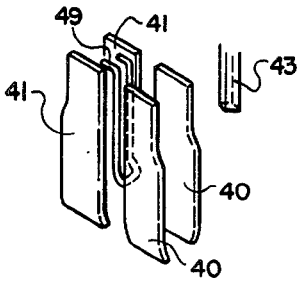
FIG. 8 is a fragmentary, schematic view of the front and rear waist bucks and showing the small garment attachment.

As is shown in FIG. 3 and also in FIGS. 4 and 8, the opposing side surfaces of the front and rear waist bucks 40 and 41 do not overlap either in the closed or open position and are parallel to each other and are in the same vertical plane to collectively define opposing, planar pressing surfaces for the opposite sides of the trousers. These surfaces correspond to planar side surfaces of the side chests 23 so that surface-to-surface pressing contact is made by side chests 23 against the opposing side surfaces of front and rear waist bucks 40 and 41. Parts linkages and air cylinder positions have been rearranged in FIG. 4 to more clearly illustrate and explain the movement of the various components and is not intended to be a technically precise view of presser 10.

Figure 9:
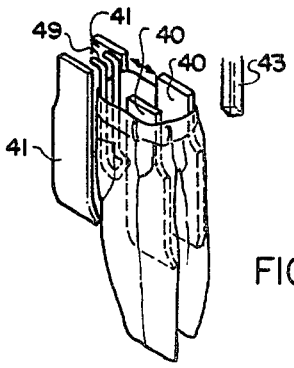
FIG. 9 shows the front and rear waist bucks according to FIG. 8 with a small pair of trousers thereon.
Figure 10:
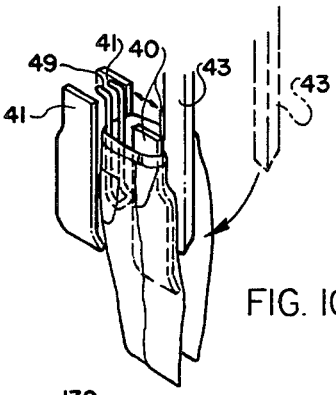
FIG. 10 shows the operation of the front and rear waist bucks when pressing a pair of small trousers.

Waist expander assembly 20 also includes a small garment positioning space defined by the innermost adjacent surfaces of front and rear waist bucks 40 and 41. Positioned on the innermost, forwardly facing surface of rear waist buck 41 is a small trouser grip comprising a downwardly extending spring 49 which defines a very narrow space between it and rear waist buck 41. Spring 49 is also shown in FIG. 8. Using spring 49 a very small size pair of trousers can be properly pressed on the presser without changing the waist bucks 40, 41 and side chests 23. Referring to FIG. 9, a pair of small trousers is shown in position on the waist expander assembly 20 with the pair of trousers encircling the front waist bucks 40 and with the rear portion of the trouser waist slipped under spring 49. When the trouser fly is properly centered between the two front waist bucks 40, the fly buck 43 extends downwardly as is shown in FIG. 10. Then, the front and rear waist bucks 40 and 41 are opened, tensioning the small pair of trousers in the manner shown in FIG. 10. Then they are pressed in the normal manner as described below.

The entire waist assembly 20 as described above is slidably mounted on frame 12 within cabinet 11 for movement between a pressing position forward the center buck 22 through access opening 16, and a pressing position inside cabinet 11 over center buck 22. To accomplish this, the entire head assembly 19 is mounted on a pair of tracks 50 which comprise elongate Thompson rods 51 extending laterally outwardly from each side of the head assembly 19. The Thompson rods 51 cooperate with a pair of slides 52 which extend inwardly from the frame members of frame 12 on either side thereof. The head assembly 19 and waist expander assembly 20 are each moved forwardly and rearwardly by an air cylinder 53.

Referring now to FIG. 4, center buck 22 is provided with a plurality of apertures **22*a* on both of its sides. The interior of center buck 22 is hollow and communicates with a vacuum source 60. Vacuum source 60 communicates with the interior of center buck 22 thus exerting a vacuum force through the apertures 22*a*** on either side thereof.

Figure 25:
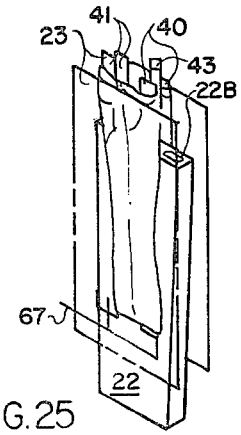

Center buck 22 includes means for assisting in the steaming and drying of the crotch area of the trousers and comprises a plurality of apertures **22*b* in the top of center buck 22. These apertures are best shown in the sequence of drawings between FIGS. 15 and 25**.

Referring again to FIG. 4, a wire skeleton 61 having a saddle-like shape corresponding generally to the shape of the crotch of a pair of trousers is positioned in spaced-apart relation to the top surface of center buck 22. When trousers are mounted on center buck 22, the crotch rests on wire skeleton 61 and are therefore spaced apart from the top of the center buck 22. This permits free air movement in the space between the crotch of the trousers and the vacuum being exerted through apertures **22*b***.

According to the embodiment disclosed in this application, the vacuum means 60 is active at all times but the vacuum exerted through center buck 22 is controlled by means of a solenoid valve which is controlled by air cylinder 62 which moves alternately between open and closed poistions and thus interrupts vacuum through center buck 22 at pre-determined intervals.

Leg expander assembly 25 includes two downwardly extending legs 65, one on each side of center buck 22. Slidably positioned on the bottom of each leg 65 is a slidable collar 66, to which is mounted a cuff expander 67 of conventional design. Each cuff expander is alternately expanded and contracted by means of an air cylinder 68. Each cuff expander 67 is raised and lowered into its dressing and pressing positions, respectively, by means of air cylinders 70 which are secured by one end to leg 65 and by the other end to cuff 66.

The entire leg expander assembly 26 is mounted on tracks comprising two elongate, spaced-apart Thompson rods 71 which cooperate with slides 72 carried by legs 65 (FIG. 3). The legs 65 move on Thompson rods 71 forward through access opening 16 into a dressing position and rearwardly on rods 71 into a pressing position on either side of center buck 22. Movement is effected by an air cylinder 73 (FIG. 4). Leg expander assembly 26 operates completely independently of the head assembly 19 and waist expander assembly 20 for easier adjustment and for less load on various moving parts.

As noted above, leg expander assembly 26 has two separate and distinct movements at right angles to each other. The dressing position is achieved by raising the cuff expanders 67 while legs 65 are forward of the access opening 16. The pressing position is assumed when cuff expanders 67 are lowered and legs 65 are within cabinet 11 on either side of center buck 22. Note that waist expander assembly 20 and leg expander assembly 26 both move in a translation-only direction to and from their respective dressing and pressing positions.

Figure 22:
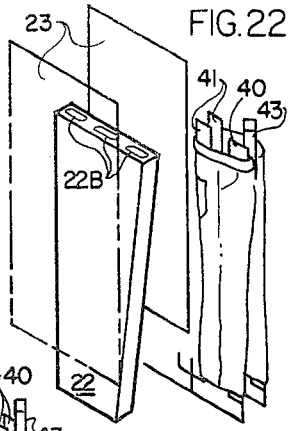

Because of the translation-only movement described above, it is a simple matter to extend the waist expander assembly 20 and leg expander assembly 25 outwardly as far as is necessary through access opening 16. This is best illustrated in FIGS. 15 and 22. This cannot be readily accomplished in machines where the waist expander and leg expander movement is unitary and where the waist expander pivots to allow access to it by the operator.

As will be described in more detail below, side chests 23 are heated to a very high temperature and also discharge live steam. It is therefore imperative that the operator's hands and body to be kept as far away from side chests 23 as possible. Mounting the waist expander assembly 20 and leg expander assembly 26 separately and permitting them to move in translation-only movement forward through access opening 16 facilitates this function while simplifying the construction, operation and adjustment of presser 10.

Figure 7:
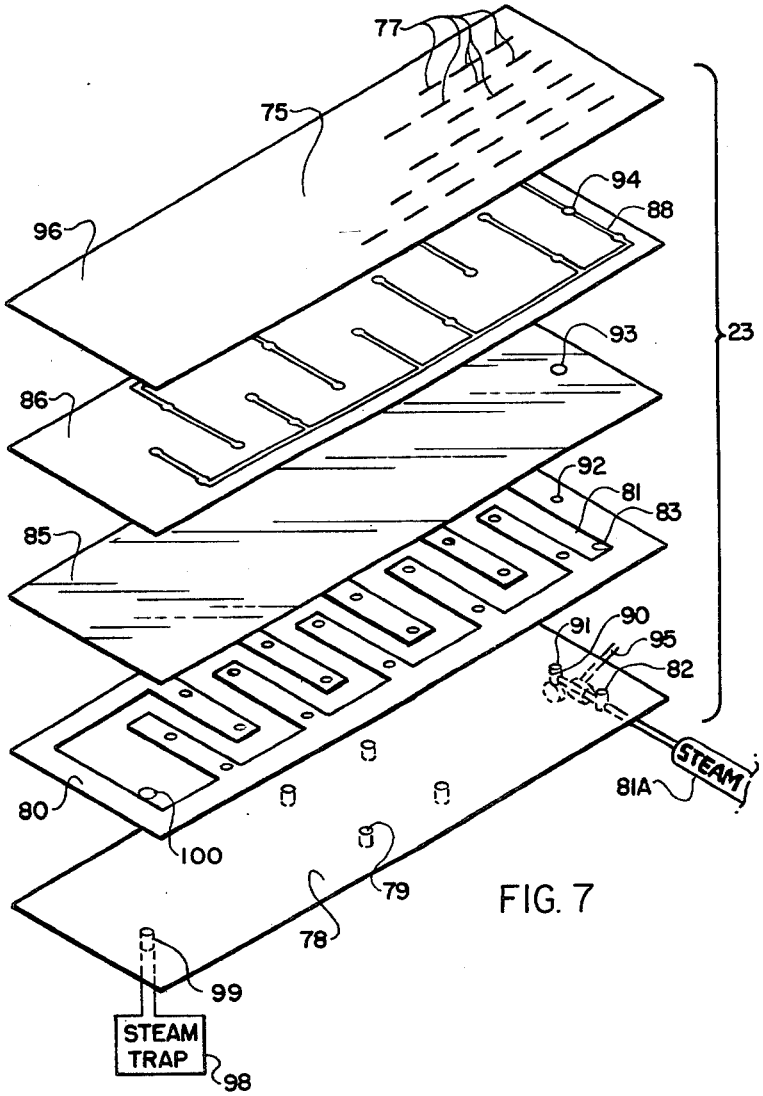
FIG. 7 is an exploded view of one of the side chests according to the invention.
Figure 11:
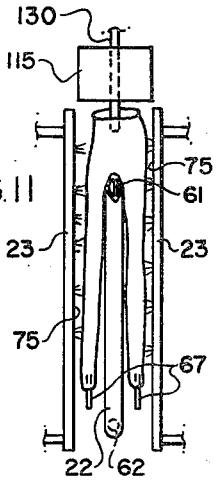
FIG. 11 is a schematic, front elevational view of the invention showing steam being applied to the garment from slots in the side chests.
Figure 12:
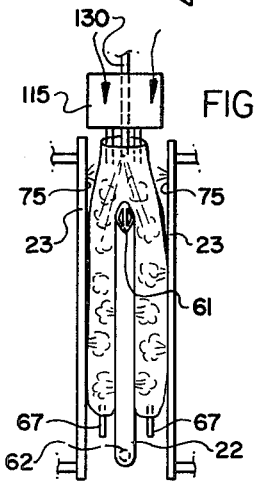
FIG. 12 shows a pair of trousers being inflated with steam and air while being steamed from the side chests.
Figure 13:
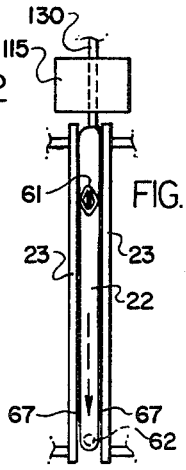
FIG. 13 shows the trousers being pressed by the side chests, while vacuum is exerted on the center bucks.

Referring now more specifically to the side chests 23, their relative positions are shown schematically in FIGS. 11 through 13. As is shown in these figures, their movement is between a retracted position away from the center buck 22 and a pressing position against center buck 22 during a pressing cycle. Movement of side chests 23 is effected by inflatable air bags 76 (FIG. 3). Each of the side chests 23 defines a pressing plate 96 having a pressing surface 75 which is provided with a plurality of laterally and longitudinally spaced-apart, elongate apertures 77. (FIG. 7). Still referring to FIG. 7, an exploded view of one of the side chests 23 is shown. One side of the side chest 23 comprises a mounting plate 78 which is provided with a plurality of mounting bolts 79. To the mounting plate 78 is affixed by welding a means for heating, which comprises a serpentine heater channel 81 which extends along the width and length of a heater plate 80. Steam is fed from a steam source 81*a* into heater channel 81 through an aperture 82 in mounting plate 78 and a communicating aperture 83 in heater channel 81. A steel membrane 85 is welded to ehater plate 80. On the other side of membrane 85 from heater plate 80 is a steam supply channel plate 86. Positioned on steam supply channel plate 86 is a steam supply channel 88 which has a serpentine shape along the width and length of steam supply channel plate 86. It should be noted that the serpentine shape of the steam supply channel 88 at no point overlaps with the serpentine shape of heater channel 81. This permits heater channel 81, steam supply channel 88, heater plate 80 and steam supply channel plate 86 to lie closer together in more intimate heating exchanging relation. In addition, the overall width of side chest 23 is reduced. Serpentine steam supply channel 88 communicates with the steam source 81*a* through a steam valve 90 through communicating apertures 91 in mounting plate 78, aperture 92 in heater plate 80, aperture 93 in membrane 85 and aperture 94 in steam supply channel plate 86. A solenoid 95 controls the emission of steam into steam supply channel 88 as will be described below. Steam supply channel 88 communicates with apertures 77 along its length and width in a multitude of locations so that an even and uniform quantity of steam is supplied to all of the apertures 77. Apertures 77 comprise vertically extended slots which, it has been found, prevent the premature formation of water bubbles and condensation of steam as steam is applied to the trousers through apertures 77. By positioning steam supply apertures 77 along the entire length and width of the pressing surface 75, steam can be applied uniformly at substantially right angles to the entire width of the garment. Since a uniform quantity of steam is supplied to the garment, the drying time of the garment is much more uniform than when steam is supplied at an oblique angle to the garment from a single position. Pressing plate 96 is constructed of stainless steel. The surface of the stainless steel is preferably frame-treated in order to prevent marking of the trousers during pressing.

Condensation is removed from heater channel 81 through a steam trap 98 which communicates with heater channel 81 through apertures 99 and 100 in mounting plate 78 and heater plate 80, respectively.

Figure 14:
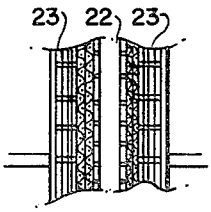
FIG. 14 is a vertical cross-sectional view taken through the side chests, trousers and center buck as shown in FIG. 13.

Before the trousers are pressed, they are inflated with hot air and steam to remove any remaining wrinkles. This process is best shown in FIG. 11, where the trousers are shown being bathed with steam from side chests 23; FIG. 12, where the trousers are shown being inflated with hot air and steam, while still being steamed from the outside; and, FIGS. 13 and 14, where the trousers are being pressed.

Figure 5:
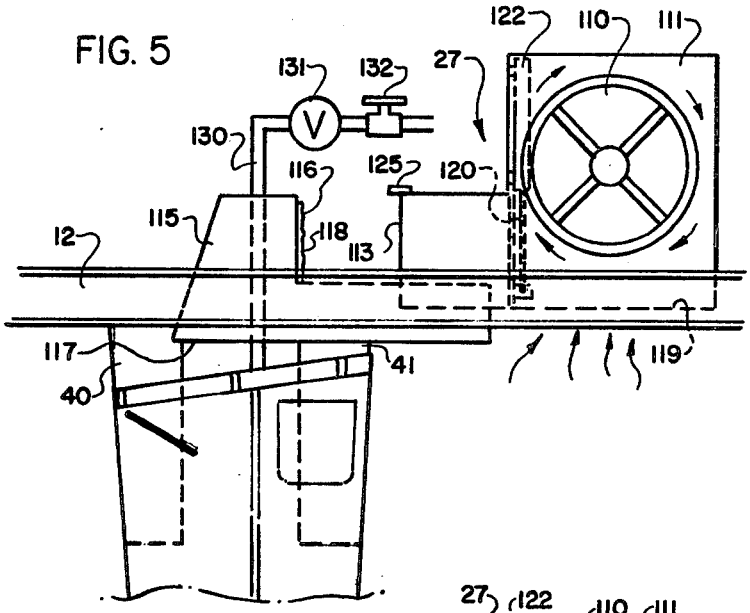
FIG. 5 is a side elevational view of the trouser presser which injects steam into the interior of the trousers and inflates the trousers to remove wrinkles, showing the air blower in its open, non-communicating position relative to the duct.
Figure 6:
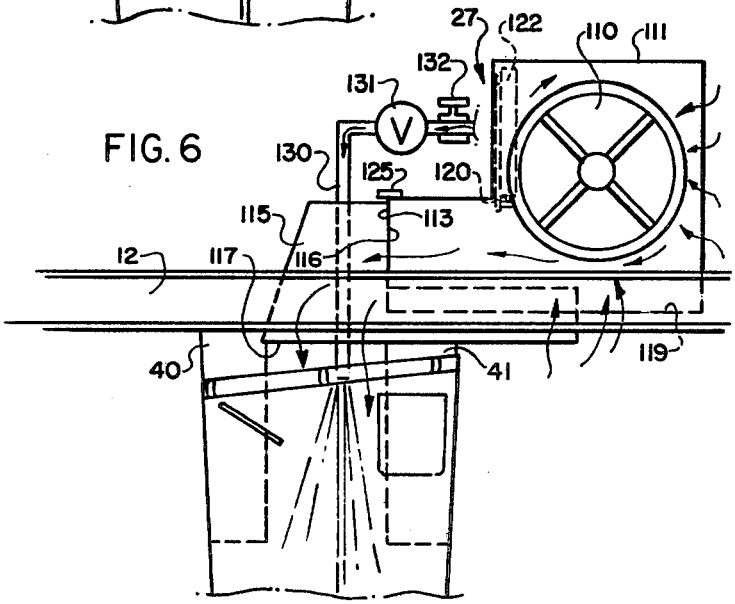
FIG. 6 is a view similar to FIG. 5, showing the air blower in its closed position for discharging air into the trousers.

Referring to FIG. 5, a pair of trousers is shown mounted on front and rear waist bucks 40 and 41. Stationarily mounted on a frame member above waist expander assembly 20 on head assembly 19 is trouser inflator means 27. Trouser inflator means 27 comprises a blower 110 rotatably mounted within a blower housing 111. Blower 110 is driven by motor 112 (see FIG. 2). Blower housing 111 is provided with a downwardly directed air inlet 119 and an air outlet 113. These components reside in a fixed position on frame 12 and do not move fowardly and rearwardly with the waist expander assembly 20. Positioned on waist expander assembly 20 for movement therewith are duct means 115 having an inlet 116 and a downwardly directed outlet 117. Inlet 116 moves into airflow communication with blower outlet 113 upon movement of waist expander assembly 20 into pressing position over center buck 22 (FIG. 6). A suitable soft sealing material, such as silicone rubber 118, is positioned around the mouth of inlet 116 to seal against the escape of air at the connection between outlet 113 and inlet 116.

When waist expander assembly 20 moves forward through opening 116 into its dressing position, outlet 113 and inlet 116 separate. To prevent air from continuing to flow through outlet 113 in this position, a damper 120 in blower housing is controlled by an air cylinder 122 to open when waist expander assembly 20 is in its pressing position and to close when waist expander assembly 20 is in its dressing position. Placing the blower 110 and housing 111 on the stationary portion of the frame makes possible a much lighter waist expander assembly 20 and head assembly 19 since not nearly as much weight is being moved with each cycle of the machine. The downwardly directed air inlet 119 into blower housing 111 reclaims waste heat by collecting heat rising from side chests 23 and directing the waste heat into duct 115 for inflation of the trousers. By reclaiming this waste heat, the provision of heating coils in cooperation with blower 110 is unnecessary, constituting a substantial savings in energy. Also, since a substantial amount of heat is reclaimed and reused, the surrounding environment is more comfortable for the operators.

Blower 110 is rotating at all times, whether or not air is being conducted into duct 115 to inflate the trousers. With damper 120 in its closed position (FIG. 5) blower 110, rotating rapidly, compresses air within blower housing 111 as it flows upwardly from side chests 23. Rotation of blower 110 compresses the air containing the waste heat which results in further generation of heat due to molecular friction.

A limit switch or any other suitable detector 125 is responsive to the presence of airflow communication between blower outlet 113 and duct inlet 118 to activate air cylinder 122 to open and close damper 120, as is required.

In addition to waste heat used to inflate the trousers, steam is also injected into the trousers through a steam pipe 130 connected to a suitable steam source (not shown). Steam pipe 130 is mounted on and moves with head assembly 19. The timing of the steam flow into the trousers is controlled by a valve 131 which in turn is controlled by the control panel 35. The steam pressure is controlled by a conventional pressure controller valve 132.

Figure 20:
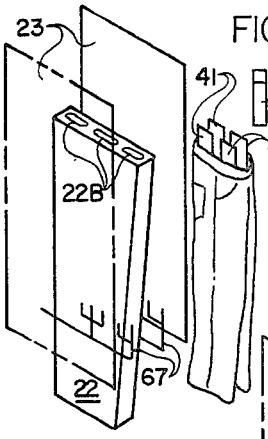
FIGS. 20 through 25 are schematic views of the trouser presser according to the present invention in various stages of operation with a pair of trousers thereon.

Referring now to FIGS. 15 through 25, the overall operation of presser 10 will be explained. In FIG. 15, the presser 10 is shown schematically with waist bucks 40 and 41 well forward of center buck 22 and in a contracted position to receive the trousers. Fly buck 43 is in its raised position. The leg expanders are down and also extended forward of center buck 22. After the trousers have been placed on waist bucks 40 and 41 and the fly buck 43 lowered into position, the leg expander assembly 26 rises to receive the trouser cuffs. Once the trouser cuffs are properly positioned, leg expander 26 is lowered (FIG. 17). Then the waist expander assembly 20 and leg expander assembly 26 independently move rearwardly into their pressing positions, with waist expander assembly 20 positioned directly over center buck 22 and one leg expander assembly 26 positioned on either side of center buck 22. At this point, the side chests 23 move together aginst center buck 22 to press the trousers as is shown in FIG. 19. When the pressing operation is completed, waist expander 20 and leg expander assembly 26 each extend to their outer positions at which time cuff expander 67 retracts from the trouser cuff and waist expander assembly 20 assumes its retracted position and the fly buck 43 rises. Trousers are held by the rear take-up 46 until removed by the operator. Referring now to FIG. 20, the operation will be explained with reference to a pair of trousers visually in position on presser 10.

Figure 21:
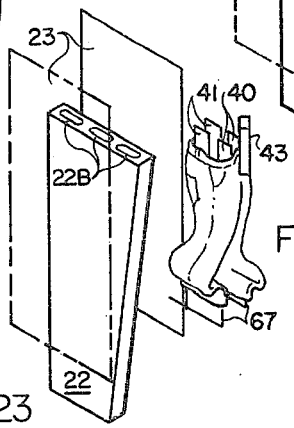

In FIG. 20, the torso part of a pair of trousers is placed around the front and rear waist bucks 40 and 41, respectively, making sure to center the fly of the trousers in the fly area between the two front waist bucks 40. While holding the pants in their proper position, the operator reaches out and presses the step forward button 30 to either side of the waist expander assembly 20 causing the fly buck 43 to move down and press against the fly portion of the trousers (FIG. 21). Both step forward buttons 30 must be pressed at the same time so that the operator's hands are sure to be away from the heated fly buck. (See FIG. 1).

Then the operator reaches behind the trousers and places the trousers within the rear take-up 46 and adjusts the trouser waist to the proper angle. The trousers are held at the proper angle and the operator's knee is used to press the knee button 33 which causes the front and rear waist bucks 40 and 41 to move away from each other, tensioning the trousers thereon and at the same time causing the leg expander assembly 26 to move into its raised dressing position.

The cuffs of the trousers are placed over the cuff expanders 67, making sure that the side seams of the trousers are straight. (FIG. 22). The step forward buttons 30 are then pressed, causing the leg expander assembly 26 to drop to its lower position. Steam is then injected through the top of the waist for two or three seconds through steam pipe 130. The trousers are still positioned forward of the access opening 16 so that they can be inspected by the operator. After the trousers have received the steam, they are softer and more moldable so that they can be adjusted as necessary to a proper fit for pressing.

Figure 23:
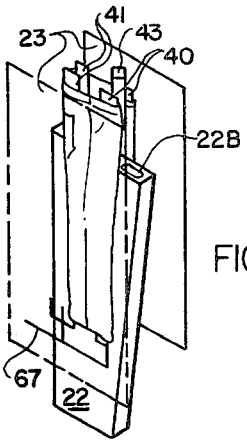
Figure 24:
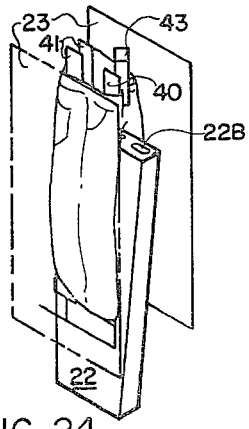

After the two to three second steaming, the steam through steam pipe 130 is shut off. Then the operator presses the step forward buttons 30 again. Side steam through side chests 23 is activated and the trousers are moved into position over the center buck 22 as waist expander assembly 20 and leg expander assembly 26 independently move rearwardly (FIG. 23). The steam bath through side chests 23 lasts for approximately five to seven seconds. During this time the top steam through steam pipe 130 is again activated. Damper 120 opens, allowing hot air to flow into duct 115 and into the trousers, inflating them and eliminating any remaining wrinkles. (FIG. 24). The side chests 23 are moved toward center buck 22 at which time steam through side chests 23 and steam pipe 130 is shut off. Vacuum is then permitted to operate through the center buck 22 by opening cylinder 62. Hot air is still blowing through duct 113 as vacuum is exerted on the trousers through center buck 22, including vacuum through apertures **22*b*. Typically, the hot air through duct 115 is shut off three or four seconds after side chests 23 are closed against the trousers (FIG. 25) by activating air cylinder 122 to lower damper 120. The time during which the side chests 23 are against the center buck 22 is variable. At the appropriate time, side chests 23 move away from the center buck 22 with the vacuum through center buck 22 still on. Vacuum through center buck 22 continues for approximately three seconds after the side chests 23 retract away from the center buck 22, permitting further drying to take place especially in the crotch area of the trousers. Then, waist expander assembly 20 and leg expander assembly 26 extend to their outer position at which time the cuff expanders 67 and front and rear waist bucks 40 and 41 retract to assume the dress position and the fly buck 43 rises. The trousers are removed from the waist expander assembly 20** and the procedure is repeated.

A safety feature is provided in the form of the step back buttons 34—one provided on either side of knee button 33. Pressing either step back button 34 "backs up" the operation of presser 10 one step as described above. Pressing either step back button 34 a second time causes it to back up one more step. Therefore, should an operator ever need to quickly reverse the operation of the presser 10, a knee against either of the step back buttons 34 will immediately cancel the existing function and back the presser 10 up to its previous function.

The step back button 34 can also be used during the initial steaming operation described above. By pressing the step back button 34 and then pressing both step forward buttons 30, the steaming through pipe 130 through the top of the trousers is repeated, allowing further steam to penetrate the trousers to allow additional adjuston on waist expander assembly 20.

Figure 26:
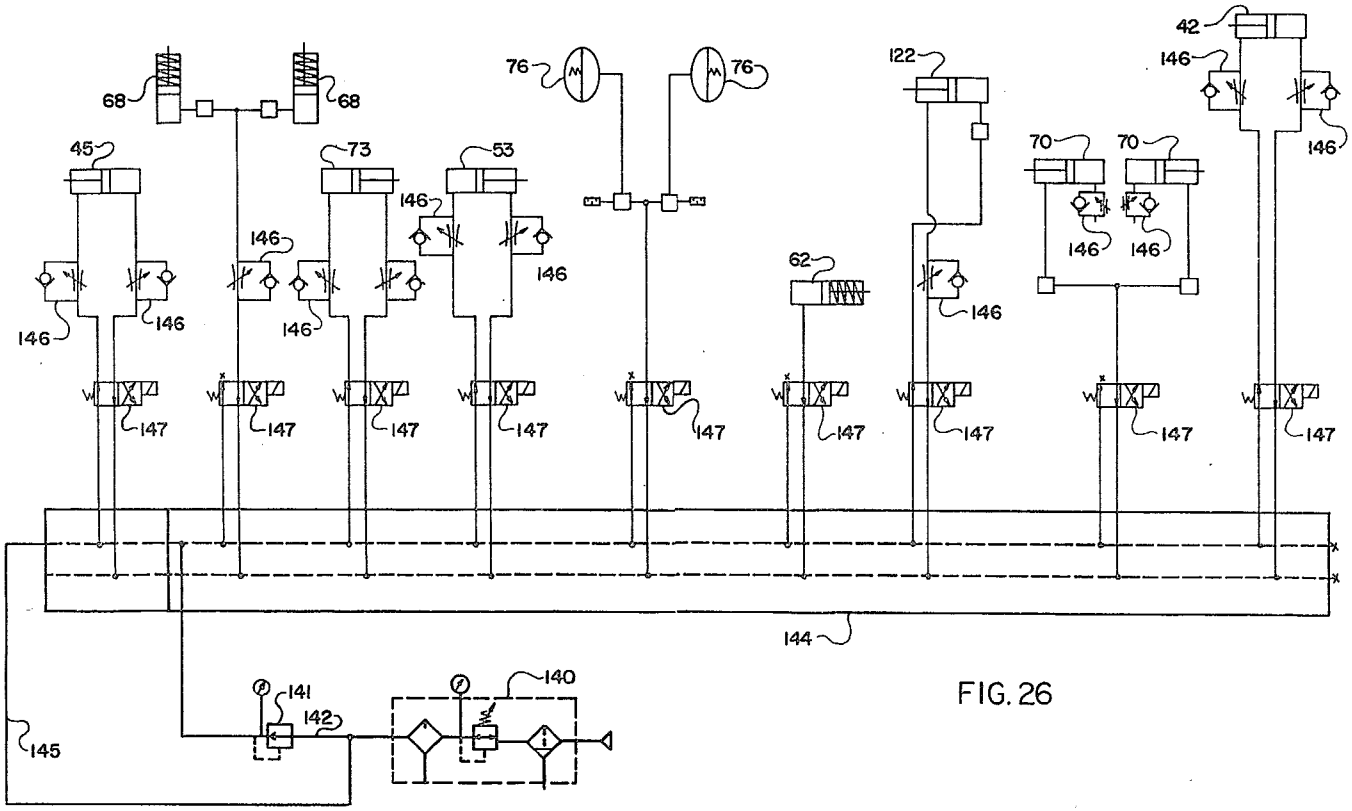
FIG. 26 is a schematic of the pneumatic circuit of the trouser presser.

The pneumatic system of presser 10 is shown in FIG. 26. Compressed air from an outside source is treated in a filter, regulator and lubricator 140. Dust and other contaminants are removed from the air, the pressure and moisture content of the air is regulated and a small amount of lubricant is added to the air. The air is then conveyed to another pressure regulator 141 through a line 142, and then to a manifold 144. Another line 145 bypasses regulator 141 directly to manifold 144. All mechanical features of presser 10 operated by compressed air are tapped off of manifold 144 in the manner shown in FIG. 26. Air cylinder 45 controls the fly buck 43 and comprises a double sided cylinder connected through a pair of flow controllers 146 to a solenoid valve 147.

The two cuff expander air cylinders 68 are single sided cylinders with a spring return, including quick exhausts 149. Cylinders 68 are connected through a "tee" to manifold 144 through a flow controller 146 and solenoid valve 147.

Air cylinder 73 which pushes the leg expander assembly 26 forwardly and rearwardly is a double sided air cylinder connected to manifold 144 through flow controllers 146 and a solenoid valve 147.

Cylinder 53, which pushes head assembly 19 and the attached waist expander assembly 20 forwardly and rearwardly also comprises a double sided air cylinder connected through flow controllers 146 to a solenoid valve 147. Cylinder 53 incorporates a magnetic limit switch which signals side chests 23 to close when a magnetic point on Thompson rod 71 is reached. If, for any reason, head assembly 19 does not move rearwardly far enough, the limit switch does not activate and the side chests 23 will not close.

Cylinder 62 which controls vacuum to center buck 22 is a single sided, spring loaded cylinder connected to manifold 144 through solenoid 147. Air damper 122 is a double sided air cylinder having a quick exhaust 149 on one side thereof, with a flow controller 146 on the other side, both of which are connected to manifold 144 through a solenoid valve 147.

The leg drop cylinders 70 are both double sided cylinders with quick exhausts 149 on one side and flow controllers 146 on the other, connected to manifold 144 through solenoid 147.

Wasit expander cylinder 42 is a double sided cylinder with flow controllers 146 connected to manifold 144 through a solenold valve 140.

A trouser presser is described above. Various details of the invention may be changed without deparing from its scope. Furthermore, the foregoing description of a preferred embodiment of the apparatus and method according to the present invention is provided for the purpose of illustration only and not for the purpose of limitation—the invention being defined by the claims.

I claim:

1. A trouser presser including a frame, a stationary center buck vertically mounted on the frame, a waist expander mounted on the frame for receiving the torso portion of a pair of trousers, and leg expanders mounted on the frame for receiving the cuffs of a pair of trousers and holding the legs of the trousers in a tensioned condition on either side of the center buck and a pair of side pressing chests being mounted on the frame, one on each side of the center buck and being moveable between a retracted position away from the center buck and a pressing position against the center buck during a pressing cycle, each of said side chests comprising:

(a) pressing means defining a pressing surface for pressing a pair of trousers against the center buck said pressing means defining a pressing surface having a plurality of uniformly spaced-apart apertures along the length and width thereof;

(b) heating means for heating the pressing surface so as to permit heat transfer from the pressing surface to the trousers while each side chest is in its pressing position against the center buck; and (c) steam supply means for supplying steam to the apertures on the pressing surface for spray application of a uniform quantity of steam to the trousers at substantially right angles thereto while said pressing surface is spaced-apart from the center buck before commencement of the pressing cycle whereby a uniform application of steam is made to the torso and leg portions of the trousers followed by a uniform application of heat from the pressing surface to the torso and leg portions of the trousers resulting in uniform drying of the trousers.

2. A trouser presser according to claim 1, wherein said apertures comprises elongate slots to prevent formation of water bubbles and premature condensation of steam as steam is applied to the trousers through the apertures.

3. A trouser presser according to claim 1, wherein means for heating the pressing surface of said side chests comprise a pressure vessel for receiving pressurized, high temperature steam from said steam supply means, said pressure vessel positioned in heat transfer relation to said pressing surface but sealed against steam transfer therebetween.

4. A trouser presser according to claim 3, wherein said pressure vessel comprises a heater channel extending along the width and length of said side chest and having a steam inlet on one end of said heater channel and an outlet on the opposite end of said heater channel.

5. A trouser presser according to claim 4, wherein said outlet from said heater channel includes a steam trap for permitting condensate to exit said heater channel without loss of steam.

6. A trouser presser according to claim 1, wherein said steam supply means includes a steam supply channel in fluid communication with said apertures for distributing an even supply of steam to the pressing surface of the side chests.

7. A trouser presser including a frame, a stationary center buck mounted on the frame, a waist expander mounted on the frame for receiving the torso portion of a pair of trousers, and leg expanders mounted on the frame for receiving the cuffs of a pair of trousers and holding the legs of the trousers in a tensioned condition on either side of the center buck, a pair of side pressing chests being vertically mounted on the frame, one on each side of the center buck and being moveable between a retracted position away from the center buck and a pressing position against the center buck during a pressing cycle, each of said side chests comprising:

(a) a supply of high pressure steam;

(b) a heater for supplying heat to said side pressing chest;

(c) a steam supply channel in fluid communication with said supply of high pressure steam for supplying steam with which to steam the trousers; and (d) a pressing place for contacting said trousers and applying heat thereto; said pressing plate having a plurality of uniform, spaced-apart apertures therein communicating with its surface and with said supply of high pressure steam for directing a uniform application of steam to the trousers and the entire exposed surface area of the trousers at substantially right angles thereto whereby a uniform application of steam is made to the torso and leg portions of the trousers followed by a uniform application of heat from the pressing surface to the torso and leg portions of the trousers resulting in uniform drying of the trousers.

8. A trouser presser according to claim 7, wherein said heater comprises a heater channel in fluid communication with said supply of steam and in heat transfer relation with said pressing plate for heating said pressing plate.

9. A trouser presser according to claim 8, wherein said steam supply channel defines a heater channel for supplying a uniform quantity of steam to all of the apertures communicating with the surface of the pressing plate.

10. A trouser presser according to claim 9, and including a heat absorbing and releasing membrane positioned between said heater channel and said pressing plate and adapted to provide uniform heat transfer between said heater channel and the pressing plate.

11. A trouser presser according to claim 7, wherein said apertures comprise elongate slots to prevent formation of water bubbles and premature condensation of steam as steam is applied to the trousers.

12. A trouser presser according to claim 7, wherein said pressing place includes a stainless steel surface to prevent marking of the trousers during pressing.

* * * * *

UNITED STATES PATENT AND TRADEMARK OFFICE

CERTIFICATE OF CORRECTION

PATENT NO. : 4,479,315

DATED : October 30, 1984

INVENTOR(S) : Leonard Frushtick

It is certified that error appears in the above-identified patent and that said Letters Patent are hereby corrected as shown below:

Column 12, line 24 (in Claim 2), the word "comprises" should be --comprise--;

Column 12, line 67 (in Claim 7), correct the word "place" to read --plate--.

Column 14, line 16 (in Claim 12), correct the word "place" to read --plate--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*